US008784135B1

(12) United States Patent
Gonzales

(10) Patent No.: US 8,784,135 B1
(45) **Date of Patent: *Jul. 22, 2014**

(54) COMPRESSION PLUG FOR PORTABLE ELECTRONICS

(75) Inventor: Richard J. Gonzales, Chandler, AZ (US)

(73) Assignee: Exelis Inc., McLean, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/534,789

(22) Filed: Jun. 27, 2012

(51) Int. Cl.
*H01R 13/648* (2006.01)

(52) U.S. Cl.
USPC ..... 439/607.47; 439/447

(58) Field of Classification Search
USPC ..... 439/607.47–607.49, 447, 604
See application file for complete search history.

(56) References Cited

U.S. PATENT DOCUMENTS 2,209,814 A * 7/1940 Finger ..... 439/447
3,858,160 A * 12/1974 Denton ..... 174/135
4,582,384 A * 4/1986 Frantz et al. ..... 439/607.47
4,585,292 A * 4/1986 Frantz et al. ..... 439/607.47
5,295,859 A * 3/1994 Kawai et al. ..... 439/455
6,050,847 A * 4/2000 Kawakami et al. ..... 439/447
6,416,351 B1 * 7/2002 Ho ..... 439/447
6,595,801 B1 * 7/2003 Leonard et al. ..... 439/607.55
6,705,894 B1 * 3/2004 Comerci et al. ..... 439/607.47
6,971,905 B2 * 12/2005 Makita et al. ..... 439/447
7,614,902 B2 * 11/2009 Bayat et al. ..... 439/446

* cited by examiner

*Primary Examiner* — Gary Paumen
(74) *Attorney, Agent, or Firm* — Davidson Berquist Jackson & Gowdey, LLP

(57) ABSTRACT

A specialized cable including a compression plug and flexible wiring configured to be connected to a receptacle so that data and/or power signals can be exchanged between the electronic equipment and the device to which the cable is attached. The flexible wiring is a flat set of closely spaced parallel wires separated by insulators (e.g., plastic). The compression plug may include a contact surface (e.g., in an opening or on an exterior surface) that electrically connects to a contact surface in the receptacle. The compression plug may include a sloped or slanted top and bottom in order to facilitate inserting the plug into the receptacle.

15 Claims, 4 Drawing Sheets

FIG. 5
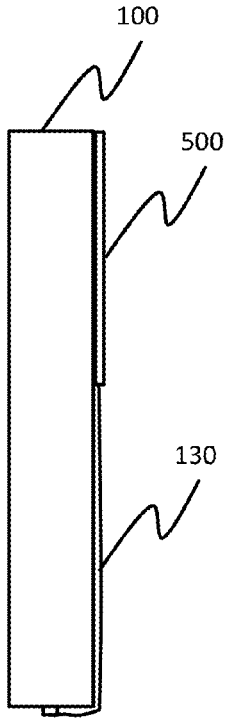
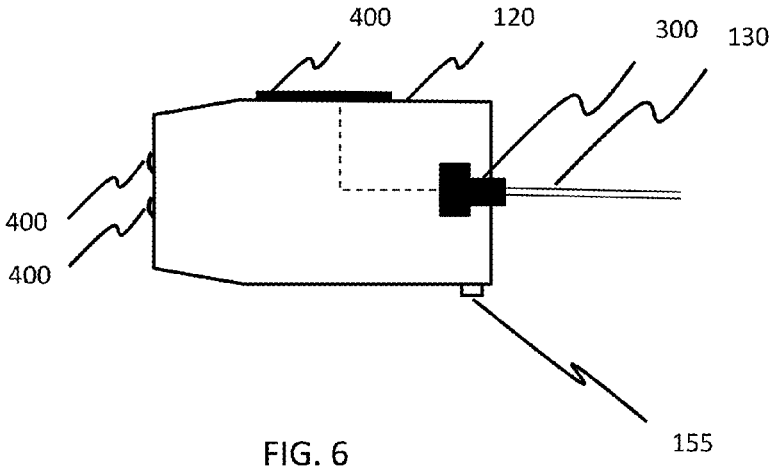
FIG. 6

COMPRESSION PLUG FOR PORTABLE ELECTRONICS

FIELD OF INVENTION

The present invention is directed to an improved wiring system for portable electronics equipment, and, in one embodiment, to a compression plug with a flex circuit/wiring to provide a reduced device profile.

DISCUSSION OF THE BACKGROUND

Known industry standard interfaces (e.g., USB interfaces) require a female receptacle and a male plug counterpart to facilitate the electro-mechanical interconnection according to the standard. In the context of the USB standards, this is generally accomplished using an industry standard USB cable which generally includes a pair of plugs. USB receptacles and plug counterparts are available in standard-, mini- and micro-mechanical variants. The pair of plugs are part of the cable assembly that facilitates the connection from the USB host (e.g., computer or smartphone) to a USB downstream device (e.g., camera).

However, USB cables, including standard-, mini- and micro-based cables, are bulky and are not generally suitable for ultra-low profile mechanical connections, where the mechanical plug and cable are not desired due to their physical size constraints which are unacceptable for certain device configurations. For example, in many configurations, the plugs can be too large and extend too far out of the receptacle when mated. This can be exacerbated by the diameter of the cable, which can be large, and the rigidity of the cable, which prevents small radius bends. Shortening the cable also does not overcome either the diameter or radius problems.

BRIEF DESCRIPTION OF THE DRAWINGS

The following description, given with respect to the attached drawings, may be better understood with reference to the non-limiting examples of the drawings, wherein:

FIG. 5 is a side view of the piece of electronic equipment connected to a security device via the cable of FIGS. 1A/1B; and FIG. 6 is a side view of a compression plug having contact surfaces on an exterior surface rather than in an interior surface of the compression plug.

DISCUSSION OF THE PREFERRED EMBODIMENTS

Figure 1A:
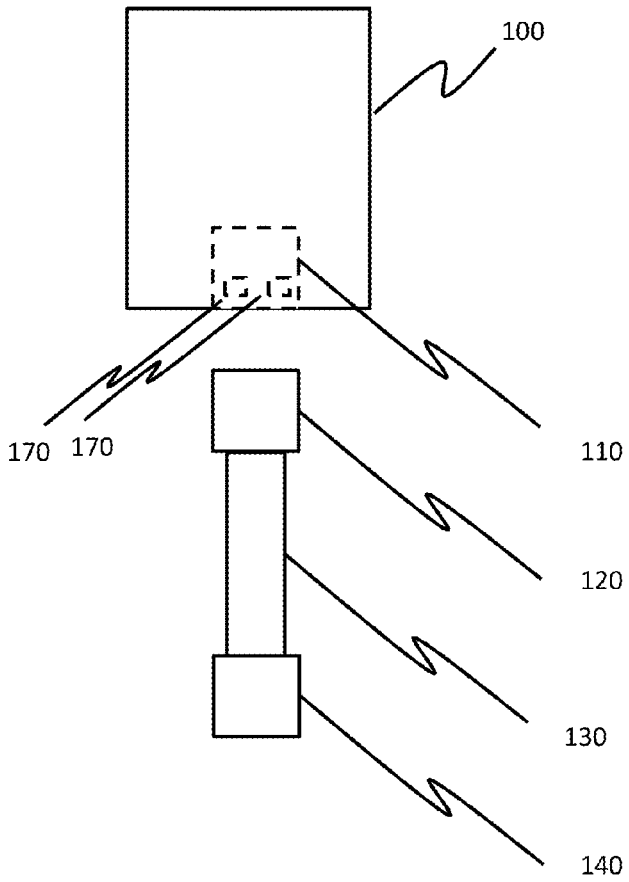
FIG. 1A is top view of a wiring system including at least one compression plug.

Turning to FIG. 1A, a wiring system is illustrated from a top view including a piece of electronic equipment 100 (e.g., a smartphone) with a receptacle 110 for communicating with other devices via a cable. (As would be understood by those of skill in the art, the designation of "top" and "bottom" are simply relative terms for opposite sides of the same cable/plug.) Exemplary receptacles include USB, USB 2.0, USB 3.0, FireWire and Thunderbolt receptacles in the standard, mini and micro formats. A specialized cable (including at least a compression plug 120 and flexible wiring 130) can be inserted into the receptacle 110 so that data and/or power signals can be exchanged between the electronic equipment 100 and the device to which the cable is attached. The flexible wiring 130 is a flat set of closely spaced parallel wires separated by insulators (e.g., plastic). At an opposite end to the compression plug 120, the cable may also include a second physical connection 140 having the same or a different connector type than the compression plug 120. In one configuration, the second physical connection 140 is the opposite end connector according to the standard used for the compression plug 120. In an alternate embodiment, the second physical connector may be non-standard compared to the compression plug 120. In fact, the compression plug may utilize the physical connections of a standard (e.g., mini-USB) without transferring the electrical signals of the standard having that physical connection. In yet a further embodiment, the cable may not include a second physical connection 140 but rather the flexible wiring may be physically integrated into the device to which the cable is connected.

Figure 2:
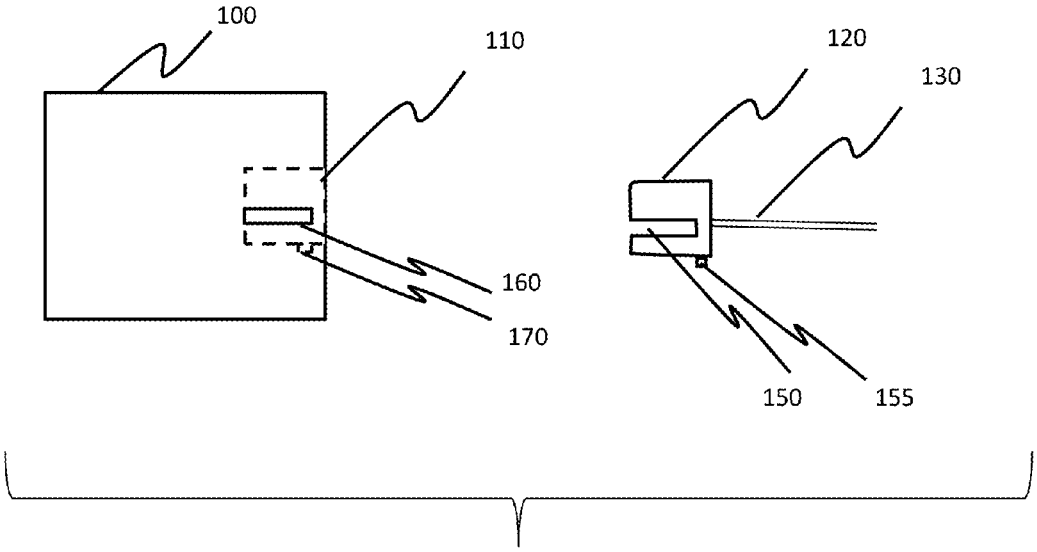
FIG. 2 is a side view of a wiring system as shown in FIG. 1A/1B.

As shown in FIG. 2, the compression plug 120 may include an opening 150 that mates with a contact plate 160 (which may be either flat or three-dimensional) in the receptacle 110. In this way, electrical contact surfaces (e.g., leads, traces or contact points) on at least one side of the opening 150 can be made to contact electrical contact surfaces on the surface(s) of the contact plate 160 which can then cause the corresponding signals to be carried from the electrical equipment 100 to the device to which the cable is attached via the flexible wiring 130.

Figure 1B:
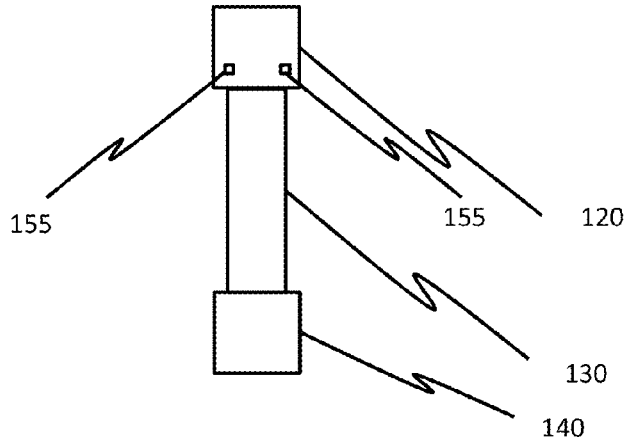
FIG. 1B is bottom view of a wiring system including at least one compression plug.
Figure 3:
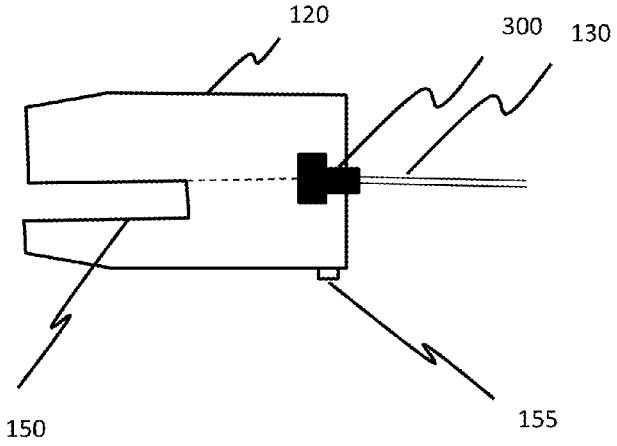
FIG. 3 is an enlarged view of the compression plug of FIGS. 1A/1B and 2.

As shown in the embodiment of FIG. 3, the compression plug 120 may be designed such that it includes at least one sloped or slanted surface (e.g., the top and/or bottom) in order to facilitate inserting the plug 120 into the receptacle by being initially smaller than the receptacle 110 as the plug 120 is inserted into the receptacle 110. (That is the distal end compared to the flexible wiring has a smaller cross-section than the portion of the plug with the largest cross-section.) However, the top and bottom are further preferably designed such that as the plug 120 is inserted further into the receptacle 110 the top and bottom of the plug 120 apply pressure to the top and bottom, respectively, of the receptacle 110. The plug is then compressed as it sits inside the receptacle. In addition, the compression plug 120 may include one or more interlocking nubs 155 (FIGS. 1B and 3) which protrude out of the compression plug 120. The interlocking nubs 155 may slide into respective holes (170) which help to hold the compression plug 120 in place.

The compression plug 120 may be designed as two separate pieces (e.g., top and bottom pieces made of plastic) that receive the flexible wiring 130 before being snapped or glued together. The pieces also may be constructed of a material that is (a) solid but compressible or (b) partially hollow such that the plug is more easily compressible.

Figure 4A:
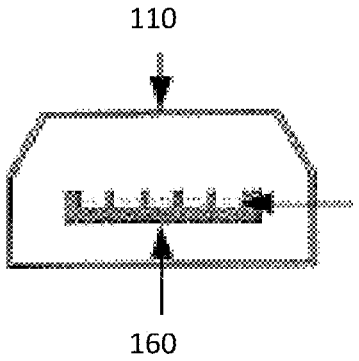
FIGS. 4A-4C are front views of an exemplary receptacle, a compression plug and a compression plug in the receptacle.
Figure 4B:
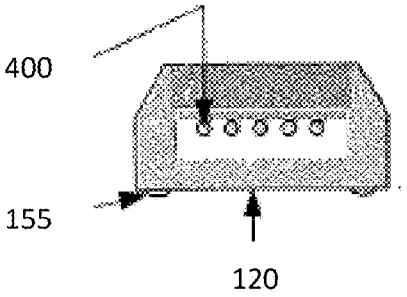
Figure 4C:
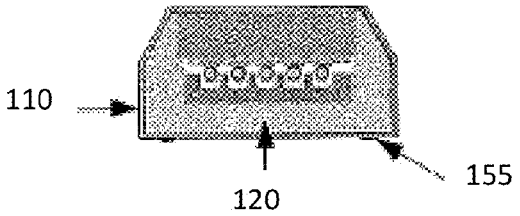

The plug 120 may further include a rubber overmold 300 that is designed to relieve some of the pressure on the flexible wiring 130 when the flexible wiring is bent. As shown in FIG. 4B, the flexible wiring 130 is stripped, exposed or otherwise electrically connected to contact surfaces 400 in the compression plug 120. This enables the contact surfaces 400 to come into contact with corresponding contact surfaces (e.g., slots) 410 (FIG. 4A) in the contact plate 160 when the plug 120 is inserted into the receptacle 110, as shown in FIG. 4C. Alternatively, as shown in FIG. 6, for other receptacle/compression plug types (e.g., non-USB connections) contact surfaces 400 may be on an exterior (e.g., top, bottom, side or front) of the compression plug 120 rather than internal to the compression plug 120.

At least a portion of the top and bottom of the plug 120 may further be made of higher friction material (e.g., textured plastic or rubber) such that the plug 120 "sticks" in the receptacle and is less likely to be knocked out of the receptacle inadvertently. The higher friction material may therefore replace the metal plug shell found in many standard plugs. If a particular receptacle needs a conductor to contact the inside of the receptacle, a contact surface (e.g., conductor strip, nub or any other contact point) can be used where the contact surface will mate with a portion of the inside of the receptacle, thereby providing a connection to shell ground. However, the remainder of the outside of the plug can be made using a higher friction material.

As shown in FIG. 5, an external device (e.g., a security module 500) may be connected to the electronic equipment 100 via the cable that includes the compression plug and its flexible wiring 130 together in a low-profile form. The cable is bent to match the contour of the electronic equipment 100 and lay flat against it. The cable may provide data and/or power to the external device, such as may be required when a smartphone, personal digital assistant (PDA) or tablet computer utilizes an external security module 500 for encryption/decryption (e.g., either of data to be viewed on the smartphone or of data and/or voice that is to be transmitted wirelessly). The external device may similarly be a secure drive (e.g., a secure flashdrive) that encrypts file contents as they are written to the external device and that decrypts file contents as they are read from the external device. Likewise, the external device could be an external camera device (e.g., for still or video images), a microphone, a sensor (e.g., heat, humidity, shock), a reader (e.g., a magnetic card reader or RF reader), etc.

While the security module 500 is illustrated as being attached to the outside cover of the smartphone, the cable could instead pass inside a modified back cover and the security module could be housed inside the smartphone. In such a configuration, the security module could be connected to the battery internal to the smartphone if voltage and/or current is needed that is different than what can be provided over the cable.

The electrical equipment also need not be handheld devices. For example, although the above can be used with a smartphone, the same technique can be used with laptops or other larger devices that nonetheless need to have external devices connected flat against the device or have cables that pass along the exterior of the devices without protruding long distances from the receptacle.

The compression plug also need not include flexible wiring if the compression plug itself is configured to wirelessly communicate with the external device. For example, a wireless communications integrated circuit may be included within the compression plug such that the electrical equipment communicates with a wireless camera. The compression plug also may provide conversion services between first and second plug standards. For example, the compression plug may convert from: USB to Ethernet, USB to SATA, USB to FireWire, USB to HDMI, USB to Thunderbolt, Ethernet to SATA, FireWire to HDMI, etc.

Similarly, the compression plug may include additional circuitry (e.g., memory circuitry or digital signal processing circuitry).

While certain configurations of structures have been illustrated for the purposes of presenting the basic structures of the present invention, one of ordinary skill in the art will appreciate that other variations are possible which would still fall within the scope of the appended claims.

The invention claimed is:

1. A cable comprising:

a compressible compression plug configured to be compressed by interior walls of a receptacle when the compression plug is inserted into the receptacle; and flexible wiring electrically connected to the compression plug and configured to carry signals from the receptacle when the compression plug is inserted into the receptacle, wherein the flexible wiring is bendable perpendicular to a direction of insertion of the compression plug into the receptacle such that the flexible wiring follows a contour of a bottom side of the compression plug upon an exit of the flexible wiring from the compression plug.

2. The cable as claimed in claim 1, wherein the cross section of the compression plug at a distal end compared to where the flexible wiring meets the compression plug is smaller than a maximum cross section of the compression plug.

3. The cable as claimed in claim 1, further comprising an overmold where the flexible wiring meets the compression plug.

4. The cable as claimed in claim 1, further comprising at least one interlocking nub.

5. The cable as claimed in claim 1, wherein the compression plug includes a first contact surface in an opening of the compression plug for electrically coupling to a second contact surface in the receptacle.

6. The cable as claimed in claim 1, wherein the compression plug includes a first contact surface on an exterior surface of the compression plug for electrically coupling to a second contact surface in the receptacle.

7. The cable as claimed in claim 3, wherein the compression plug is formed of two pieces that retain the overmold in place when the two pieces are connected.

8. The cable as claimed in claim 3, wherein the compression plug is formed of two pieces that retain the overmold in place when the two pieces are glued together.

9. The cable as claimed in claim 7, wherein the cross section of the compression plug at a distal end compared to where the flexible wiring meets the compression plug is smaller than a maximum cross section of the compression plug.

10. The cable as claimed in claim 8, wherein the cross section of the compression plug at a distal end compared to where the flexible wiring meets the compression plug is smaller than a maximum cross section of the compression plug.

11. The cable as claimed in claim 7, further comprising at least one interlocking nub.

12. The cable as claimed in claim 8, further comprising at least one interlocking nub.

13. The cable as claimed in claim 7, wherein the compression plug includes a first contact surface in an opening of the compression plug for electrically coupling to a second contact surface in the receptacle.

14. The cable as claimed in claim 7, wherein the compression plug includes a first contact surface on an exterior surface of the compression plug for electrically coupling to a second contact surface in the receptacle.

15. The cable as claimed in claim 7, wherein the compression plug includes a contact surface for connecting to a shell ground of the receptacle.

* * * * *